United States Patent [19]

Johnson

[11] 4,031,566

[45] June 28, 1977

[54] NURSING GARMENT

[76] Inventor: Marilyn M. Johnson, 790 Griffith Way, Laguna Beach, Calif. 92651

[22] Filed: July 21, 1976

[21] Appl. No.: 707,450

[52] U.S. Cl. ..... 2/104
[51] Int. Cl.[2] ..... A41D 1/20
[58] Field of Search ..... 2/104, 111, 243 B; 128/478, 460

[56] References Cited

UNITED STATES PATENTS

| | | | |
|---|---|---|---|
| 2,736,031 | 2/1956 | Wyner | 2/111 |
| 3,611,439 | 10/1971 | Myers | 2/104 |

FOREIGN PATENTS OR APPLICATIONS

| | | | |
|---|---|---|---|
| 682,391 | 2/1930 | France | 2/104 |

*Primary Examiner*—Werner H. Schroeder
*Assistant Examiner*—Doris L. Troutman
*Attorney, Agent, or Firm*—Harvey C. Nienow

[57] ABSTRACT

A nursing garment wherein the various components or sections are generally rectangular in construction affording a front panel having a pair of rectangular or right angle openings, and sleeve members formed with cover portions which are substantially complementally shaped relative to said right angle openings. Such sleeve members are attached to both a front panel and a rear panel, and removable fastening means in the form of mating velcro parts are used to enable the cover portion of each sleeve member to be removed as desired, from the front panel.

5 Claims, 5 Drawing Figures

NURSING GARMENT

The present invention relates generally to nursing garments, and more particularly, to such garments which enable a mother to quickly and privately nurse a baby.

Although nursing garments have heretofore been available, they have not been of simple construction, nor have they been convenient and effective in use. Such prior garments have been complicated by the fact that all of the parts are cut along irregular lines, and hence the nursing openings in the garment are inconvenient and unattractive. Also, the fastening means employed has been of such a nature as to cause the garment to have an unattractive, ruffled appearance.

It is an object of the present invention to provide a nursing garment which can be formed of generally rectangular pieces of cloth or the like.

A further object of the present invention is to provide a nursing garment as characterized above which comprises a generally rectangular front panel the adjacent upper corners of which are each provided with a generally right angle opening or cutout.

An even further object of the present invention is to provide a nursing garment as characterized above wherein sleeve members are provided of generally rectangular construction, and which are fastened to front and rear panels to provide a unitary structure for the garment as well as providing shoulder portions therefor.

Another further object of the present invention is to provide a nursing garment as characterized above which employs velcro fastening members at spaced locations along the generally right angular opening for nursing purposes.

A still further object of the present invention is to provide a nursing garment as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawing.

Figure 1:
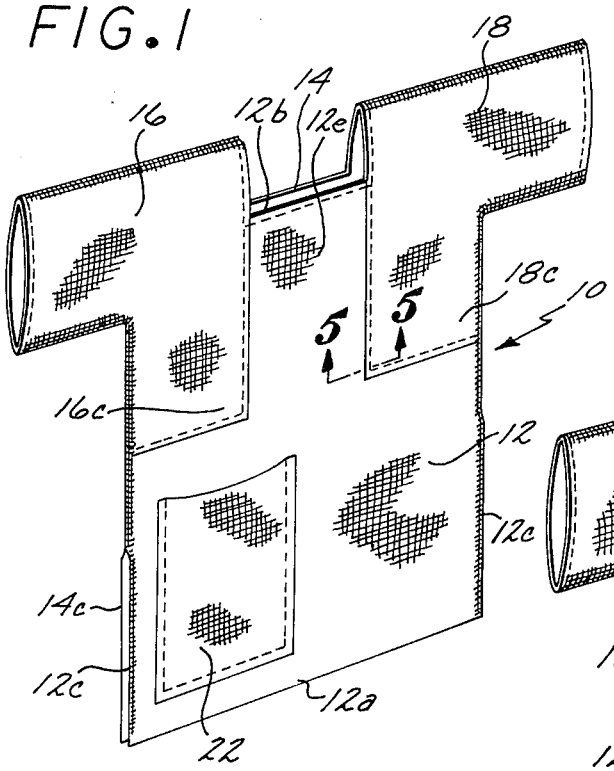
FIG. 1 is a perspective view of a nursing garment according to the present invention.

Referring to FIG. 1 of the drawings, there is shown therein, garment 10 which comprises a front panel 12, a rear panel 14 and a pair of sleeve members 16 and 18. The front panel, as shown most particularly in FIG. 2 of the drawings, is generally rectangular in construction having a lower edge 12*a*, an upper edge 12*b* and opposite side edges 12*c* and 12*d*. In similar fashion, as shown most particularly in FIG. 3 of the drawings, the rear panel 14 is formed with a lower edge 14*a*, an upper edge 14*b* and opposite side edges 14*c* and 14*d*.

Figure 2:
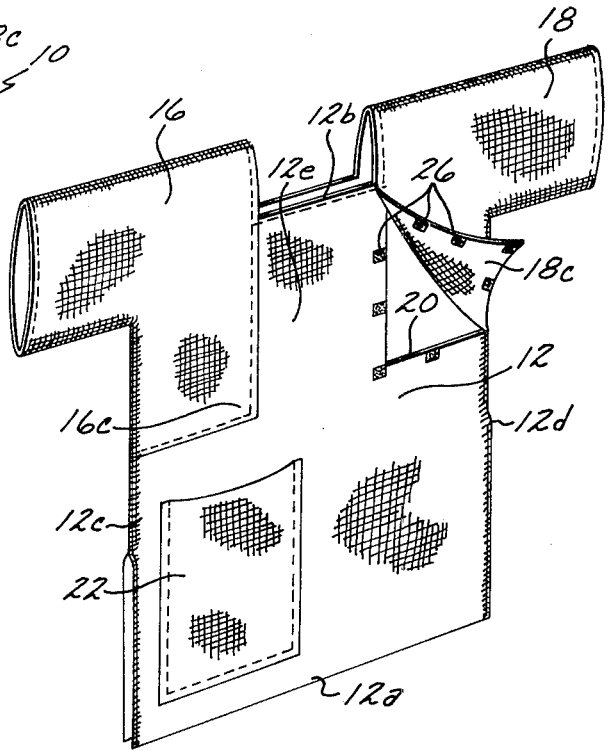
FIG. 2 is a perspective view of the garment of FIG. 1, showing details of the nursing portion thereof.

As shown in FIG. 2, the front panel is formed with a pair of right angle cutouts or openings at the opposite upper corners of the panel. FIG. 2 shows one such opening 20, it being understood that a similar opening is formed in the opposite upper corner of the front panel 12.

The rear panel 14 may or may not be formed with similar cutouts at its opposite upper corners depending upon whether or not the excess material thereat is desirable. That is, referring to FIG. 3 of the drawings, it is seen that the rear panel 14 is fastened to the sleeve members 16 and 18 which overlay the upper corners of the rear panel. Accordingly, the rear panel would not have to be formed with right angle corner cutouts or openings, but rather, the sleeve portion could be caused to overlay the same. For reasons of mass producing the subject garment, it may be found desirable to have the front and rear panels identical.

Figure 3:
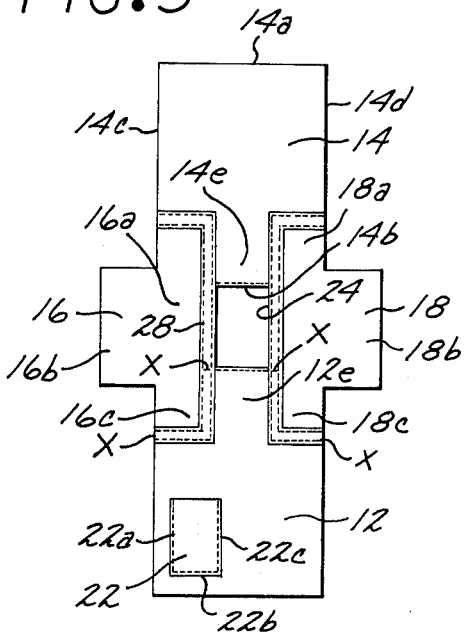
FIG. 3 is a plan view of the parts which make up the garment.

As shown most particularly in FIG. 3, the sleeve members 16 and 18 are each formed in a generally rectangular construction. The main body 16*a* and 18*a* of such sleeve members, afford shoulder portions which are connected to the front and rear panels. Each such sleeve member further comprises an extended portion 16*b* and 18*b*, respectively.

The front panel 12 is provided with a pocket 22 which is sewed to the panel 12 along edges 22*a*, 22*b* and 22*c*.

The garment 10 is constructed initially by making the front and rear panels, as well as the sleeve members, as generally shown and described. In this regard, it has been found desirable to form the front and rear panels by attaching a section 12*e* to the main body of the rear panel. If such sections are narrower in width than the main portion of the respective panel, the desired right angle cutouts in the upper corners are thereby quickly and easily provided. On the other hand, it is contemplated that the front and rear panels could be formed out of individual single sections of cloth or other material. In such event, the right angle cutouts in the corners would be provided by cutting or the like.

Thereafter, the panels and sleeve members are sewed together in the relationship shown in FIG. 3 to provide a head opening 24 in the garment. The right angle corners of the main portion 16*a* and 18*a* of the sleeve members 16 and 18 are sewed directly and continuously to the rear panel 14. However, at the front panel 12, the corners 16*c* and 18*c* of the sleeve members are merely tacked to the front panel at the locations identified with the letter X. Thus, the corner portion between the tacks is left free and loose and is not connected directly or permanently to the front panel. Rather, as shown in FIG. 2 of the drawings with respect to the corner 18*c* of sleeve member 18, mating portions 26 of velcro fastening material are fixed to the sleeve portion and the front panel 12, as shown. This affords means for securing the corner or flap of the sleeve member to the panel along the edge of the right angle opening in the latter. When it is desired to nurse the baby, it is a simple matter for the mother to separate the velcro members and to nurse the baby through one of the right angle openings in the front panel 12.

Figure 4:
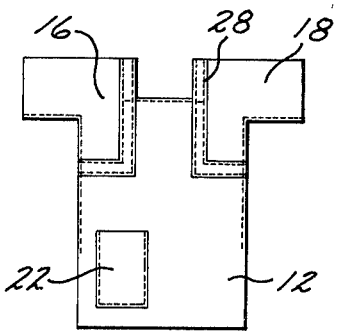
FIG. 4 is a front elevational view of the garment.
Figure 5:
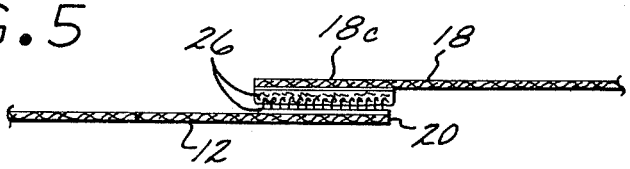
FIG. 5 is a fragmentary sectional view taken substantially along line 5—5 of FIG. 1.

If desired, and as shown in FIGS. 3 and 4 of the drawings, the garment might be completed by sewing tape 28 along the edge of the main portion of the sleeve members 16 and 18.

The garment is completed by sewing the opposite edges of the extensions 16*b* and 18*b*, respectively, of the sleeve members 16 and 18 to provide the generally tubular sleeve construction as shown most particularly in FIGS. 1 and 2 of the drawings. Also, as shown in such drawings, the adjacent edges of the front and rear panels may be sewed together to provide the bodice of the garment. This is shown in FIGS. 1 and 2 of the drawings, the side edge 12*c* of panel 12 being sewed to side edge 14*c* of rear panel 14. In like manner, side edge 12*d* of panel 12 is sewed to side edge 14*d* of rear panel 14.

It is thus seen that the present invention provides a unique garment which is formed of rectangular pieces and affords a generally right angle opening through which a baby may be nursed.

Although I have shown and described certain specific embodiments of my invention, I am well aware that many modifications thereof are possible. The claims are not to be restricted except insofar as it is necessitated by the prior art and by the scope of the following claims.

I claim:

1. A nursing garment for enabling a mother to nurse a baby comprising in combination, generally rectangular front and rear garment panels of width approximating the width of the mother's torso, said front panel being formed with a generally right angle cutout in each of two corners providing breast-exposing openings in said front panel, and a pair of sleeve/shoulder members each of which is connected to and between said front and rear panels and has a generally right angle portion which overlays the corresponding breast-exposing opening in said front panel.

2. A nursing garment for enabling a mother to nurse a baby according to claim 1, wherein each of said sleeve/shoulder members is fixed to said front panel at widely spaced locations on the marginal edge of the right angle of such sleeve/shoulder member and the marginal edge of the right angle cutout in said front panel.

3. A nursing garment for enabling a mother to nurse a baby according to claim 2, wherein the marginal edge of the right angle of each sleeve/shoulder member overlaps the marginal edge of the corresponding cutout in said front panel.

4. A nursing garment for enabling a mother to nurse a baby according to claim 3, wherein said overlapping marginal edges are fastened together with loop-pile fastening means.

5. A nursing garment for enabling a mother to nurse a baby according to claim 4, wherein said sleeve/shoulder members are generally rectangular in construction and have mating edges fastened together to provide tubular sleeves for said garment.

* * * * *